US005378173A

United States Patent [19]

Hashizawa

[11] Patent Number: 5,378,173

[45] Date of Patent: Jan. 3, 1995

[54] CONNECTOR ASSEMBLY

[75] Inventor: Shigemi Hashizawa, Shizuoka, Japan

[73] Assignee: Amada Manufacturing America, Inc., Japan

[21] Appl. No.: 101,744

[22] Filed: Aug. 4, 1993

[30] Foreign Application Priority Data

Aug. 5, 1992 [JP] Japan ..... 4-208955

[51] Int. Cl.[6] ..... H01R 13/502

[52] U.S. Cl. ..... 439/701; 439/364

[58] Field of Search ..... 439/686, 690, 695, 701, 439/364, 357, 358

[56] References Cited

U.S. PATENT DOCUMENTS

| | | | |
|---|---|---|---|
| 4,483,575 | 10/1984 | Kruger et al. | 439/364 |
| 4,780,090 | 10/1988 | Sugiyama et al. . | |
| 4,915,648 | 4/1990 | Takase et al. | 439/924 X |
| 4,923,411 | 5/1990 | Hayashi et al. . | |
| 4,963,098 | 10/1990 | Myer et al. | 439/686 X |
| 4,997,386 | 3/1991 | Kawachi et al. | 439/701 X |
| 5,073,127 | 12/1991 | Daly et al. | 439/701 X |
| 5,190,476 | 3/1993 | Chaillot | 439/701 X |

*Primary Examiner*—Khiem Nguyen

*Attorney, Agent, or Firm*—Wigman, Cohen, Leitner & Myers

[57] ABSTRACT

A connector assembly for connecting branch connectors to a main mating connector includes a frame capable of being joined with the main connector and the branch connectors being detachably mounted in the frame and capable of connecting with the main connector. The frame includes cavities for receiving each branch connector and extending from a first branch connector receiving face to an opposite face, and first engaging portions for holding each branch connector in the frame. The branch connectors each include a main body having terminals therein, and locking means provided for release from the frame first engagement means. The locking means form a second engaging portion for engagement with the first engaging portion to lock the branch connector in the frame.

14 Claims, 10 Drawing Sheets

CONNECTOR ASSEMBLY

BACKGROUND OF THE INVENTION

1. Technical Field

The present invention relates to a connector assembly in which plural connectors are mounted in one frame so as to make it possible to connect all the connectors to a mating connector at a time.

2. Background Art

Generally, in the event that plural connectors are connected to corresponding connectors or connection portions disposed in an electric Joint box in for example an automobile assembly line, the connecting work must be carried out the same number of times as the number of connectors. Thus, the handling of connectors and the connector coupling work in such a line become complicated.

To avoid such complication, there has been adopted a method in which a sub-assembly of plural connectors in one frame is prepared in advance, and the so-prepared frame is coupled to a connection portion on the mating side by bolts or the like means in the final connector coupling stage of the line. In that manner, all the connectors can be connected by fitting or the like fashion to the mating connector at a time.

U.S. Pat. No. 4,780,090 discloses a typical example of such a connector assembly called "ultra-multipolar connector" therein and having construction as shown in FIGS. 1 and 2. Moreover, another example to be applied to the electric Joint box is disclosed in U.S. Pat. No. 4,923,411.

In the connector assembly shown in FIG. 1, two connector housings 3*a*, 3*b* are disposed in a frame 1, and multipolar connectors 5*a*, 5*b* are received in these housings 3*a*, 3*b*, respectively. Moreover, a bolt 7 is supported in the central portion of the frame 1 so that the frame 1 can be sectored by a nut 11 disposed in the mating connector 9.

In the case of electric connection, the connectors 5*a*, 5*b* are fitted in advance in the respective housings 3*a*, 3*b* to form a sub-assembly, and the bolt 7 and nut 11 are then engaged together to couple the frame 1 to the mating connector 9. As the result, all of the connectors 5*a*, 5*b* are connected at a time to the terminals 13*a*, 13*b* of mating connector 9, respectively.

According to this method, the plurality of connectors 5*a*, 5*b* can be handled at a time on the stage of shipping or assembling, and the process number of final connector coupling work can be greatly reduced by preparing such a sub-assembly of these connectors 5*a*, 5*b* in frame 1.

However, in such a conventional construction, even when it is needed to remove the connectors 5*a*, 5*b* individually from the terminals 13*a*, 13*b* after the coupling, the frame 1 must be separated from the mating connector 9 by disengaging the bolt 7 from the nut 11. Therefore, the conventional method is disadvantageous in the individual maintenance of connectors 5*a*, 5*b* or in changing the number of poles, regardless of its merit in easy handling before or on the connector coupling work.

SUMMARY OF THE INVENTION

Therefore, it is an object of the present invention to provide a connector assembly in which the handling before or on the connector coupling work can be carried out easily in an assembly fashion, and in which the connectors can be removed individually so as to make possible the separate maintenance of each connector.

To achieve the above object, the present invention provides a connector assembly which comprise a frame capable of fixing on the mating connector and connectors being detachably mounted in the frame and capable of connecting with the mating connector. The frame includes cavities extending from one face to the other face of the frame and receiving each connectors from a side of the other face, and first engaging portions for holding each connector. The connector includes a main body having terminals, and a locking means provided for tile main body. The locking means have a second engaging portion for engaging with the first engaging portion in the frame.

According to the above connector assembly, each connector can be fixed in each cavity of the frame while engaging the engaging portion of the housing with the corresponding engaging portion of the locking means. Thus, a sub-assembly comprising the frame and connectors can be obtained.

Accordingly, on the connector coupling work, all of The connectors fixed in the frame can be connected to the mating connector at a time only by coupling the frame with the mating connector.

Moreover, on the maintenance, each connector can be removed individually by disengaging these two engaging portions using the operation portion of the locking means.

These and other objects, features and advantages of the present invention will be more apparent from the following description of a preferred embodiment, taken in conjunction with the accompanying drawings.

DESCRIPTION OF THE PREFERRED EMBODIMENT

Hereinafter, an embodiment of the present invention will be described with reference to the drawings.

Figure 1:
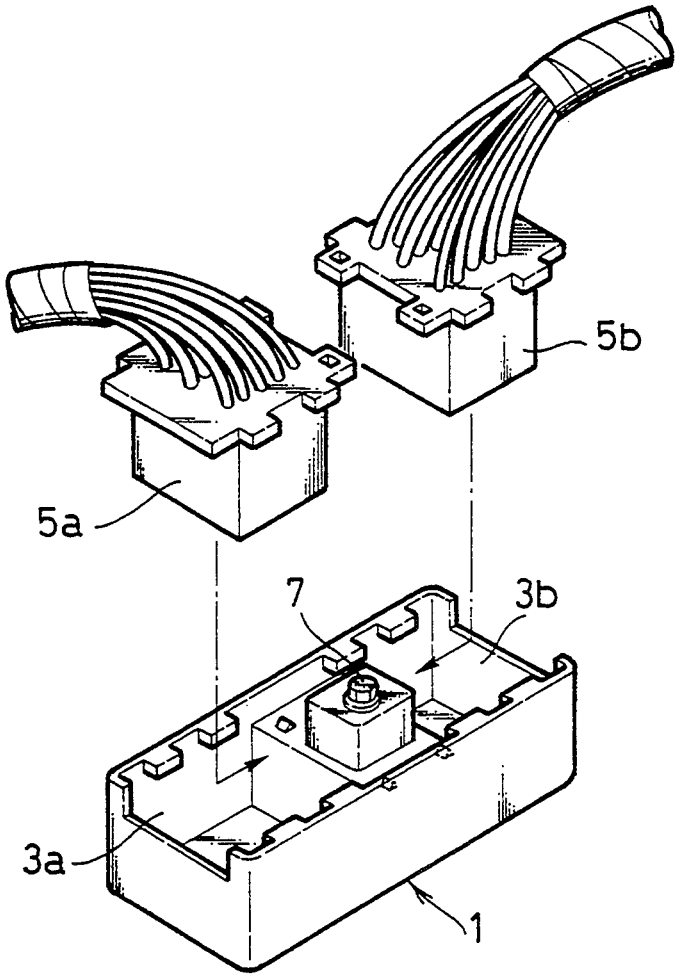
FIG. 1 PRIOR ART
FIG. 1 is a perspective view of a conventional connector assembly.
Figure 2:
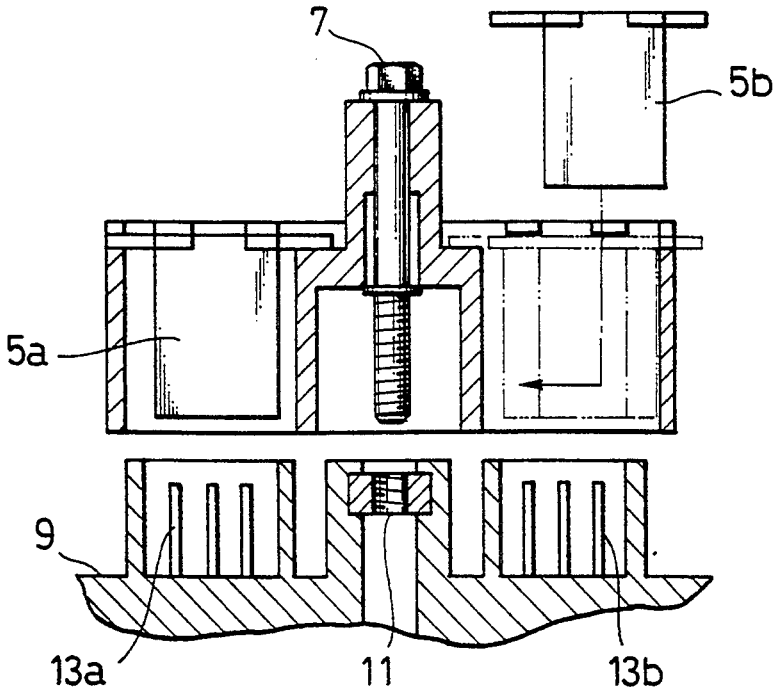
FIG. 2 PRIOR ART
Fig. 2 is a cross section of the conventional connector assembly in a coupled state.
Figure 3:
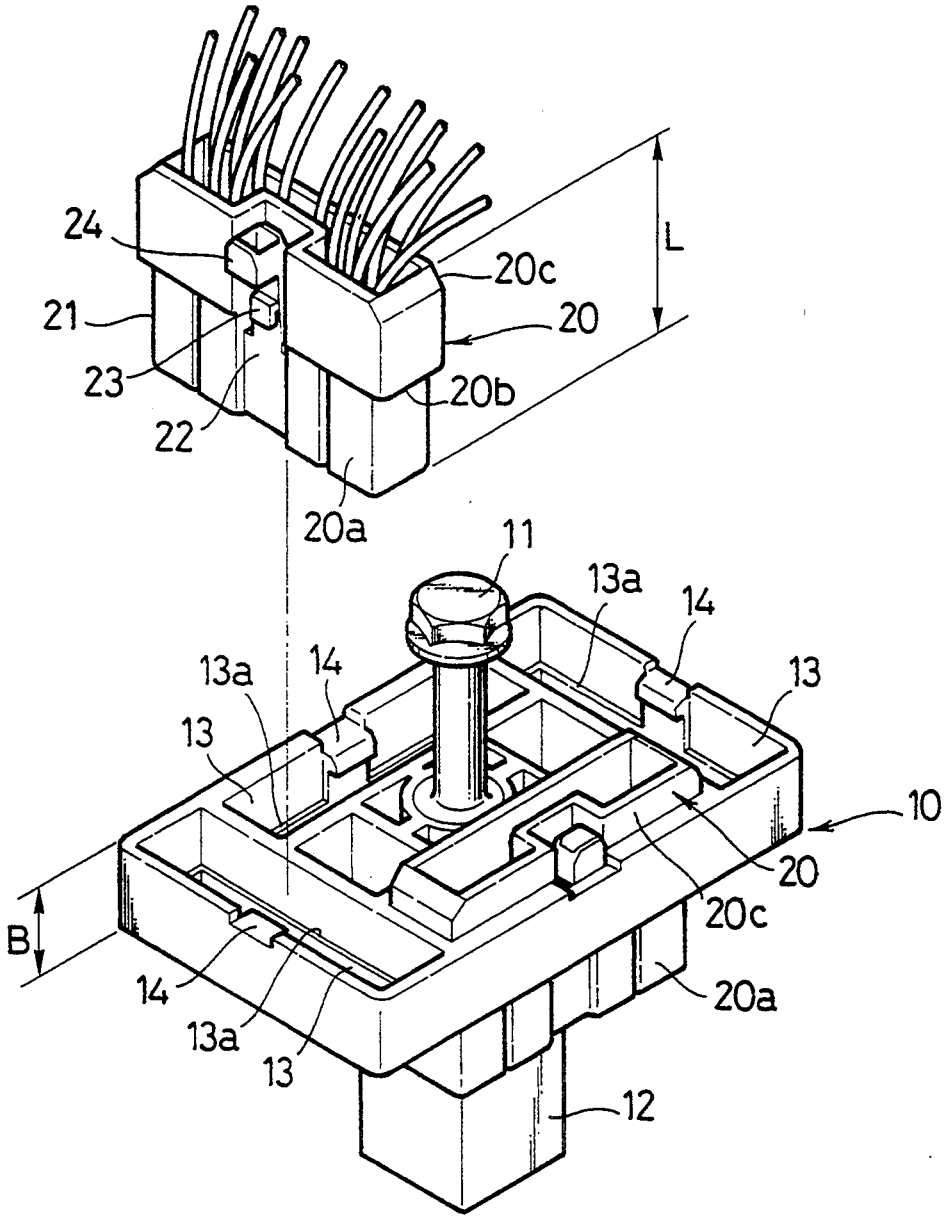
FIG. 3 is a perspective view of a connector assembly corresponding to an embodiment of the present invention before it is assembled with the mating connector.
Figure 4:
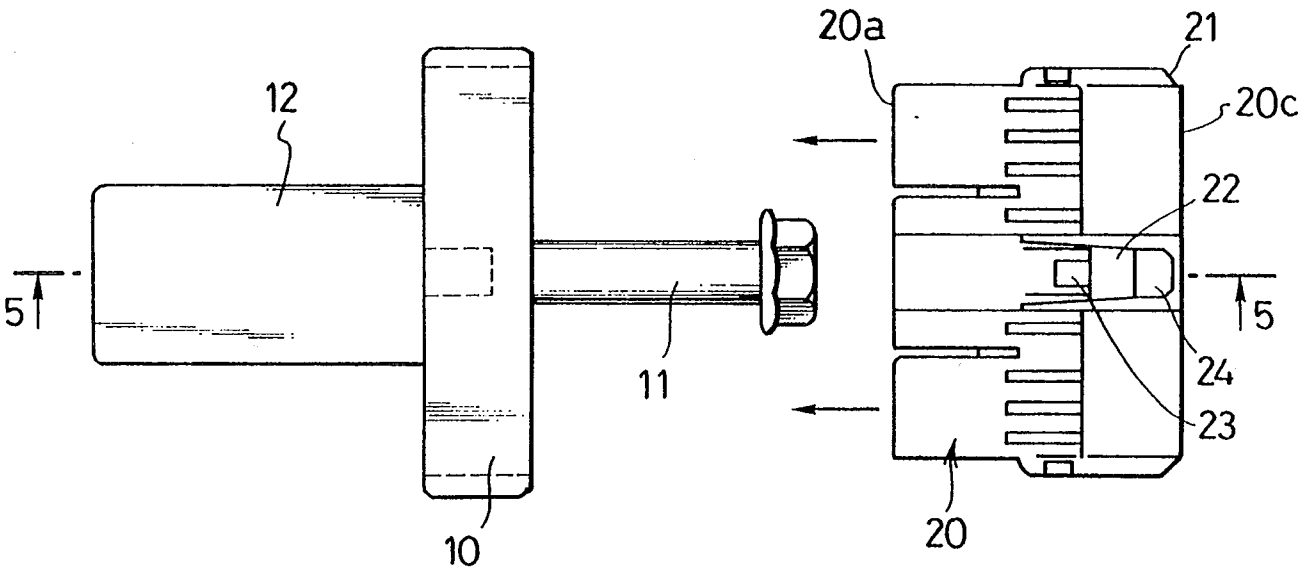
FIG. 4 is a plan view of the connector assembly corresponding to an embodiment of the present invention before it is assembled with the mating connector.
Figure 5:
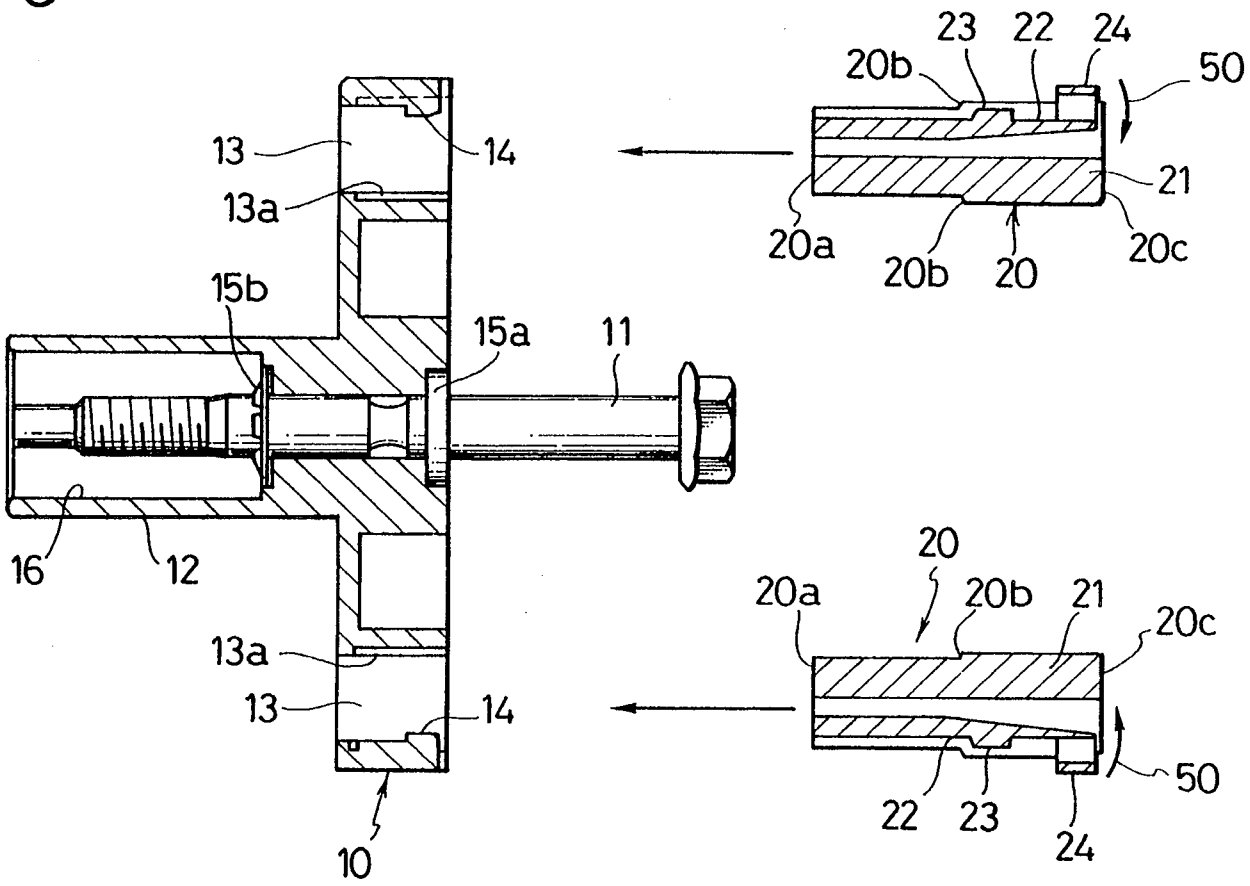
FIG. 5 is a cross section taken along the line 5—5 of FIG. 4.

FIGS. 3 to 5 show a state Just before a sub-assembly corresponding to one embodiment of the present invention is constructed, respectively. In the same drawings, a frame designated by reference numeral 10 has a rectangular shape in the main flat face thereof, in the central portion of the rectangular frame being provided a boss 12 for supporting a bolt 11 therein.

Also in the frame 10 are provided, for example, four cavities 13 around the central bolt supporting portion. Each cavity 13 is provided as a rectangular hole extending through the front face (shown as the main flat face on the left side in FIGS. 4 and 5) to the rear face (shown as the other main face on the right side in the same drawings). Moreover, the size and shape of each cavity 13 are determined so as to make it possible to detachably couple each of additional branch or corresponding connector 20 to the frame 10 from its rear side.

Figure 6:
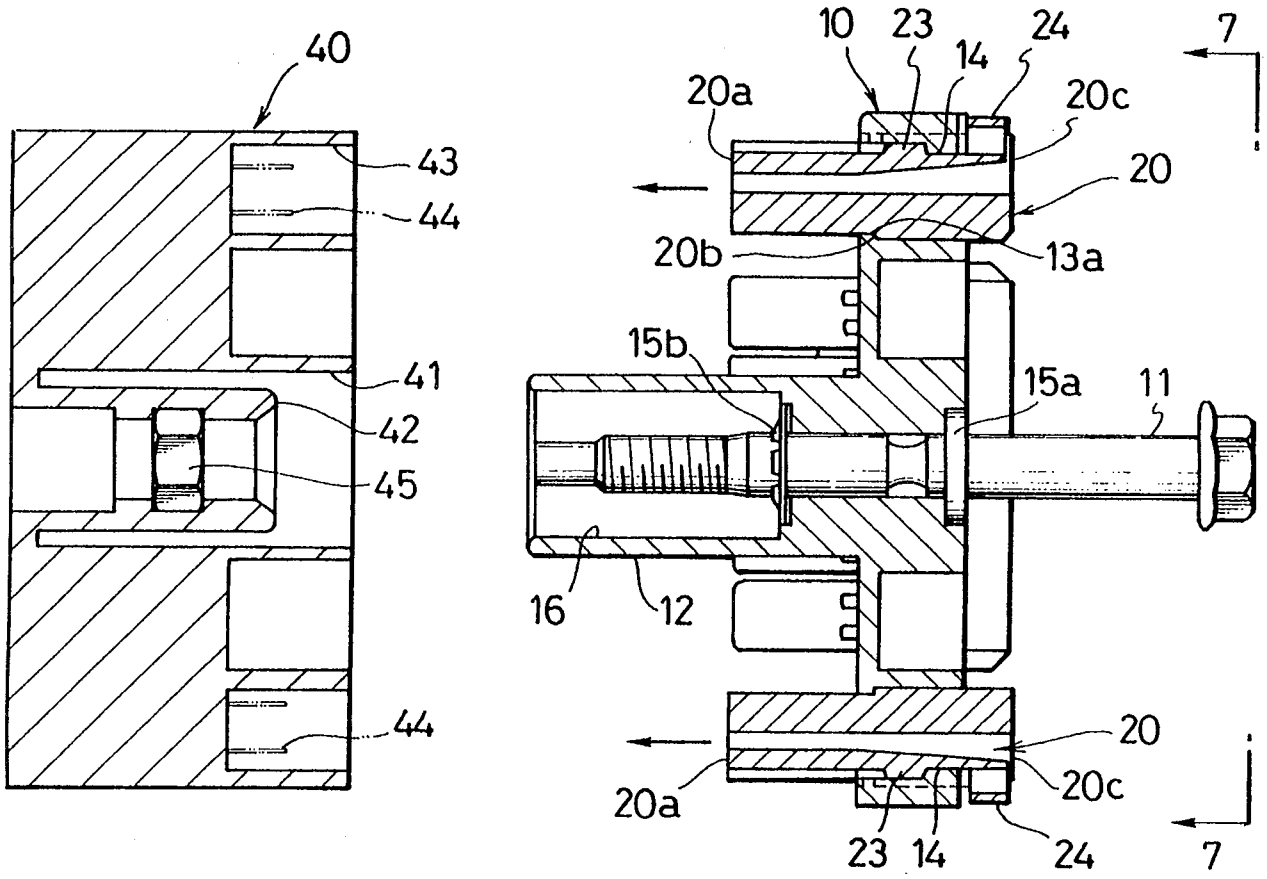
FIG. 6 is a cross section showing a state in which the connector assembly according to an embodiment of the present invention faces the mating connector.

In this case, the thickness B of frame 10 is set shorter than the length L of connector 20 so that both the end portions 20*a* and 20*c* of connector 20 can project out from the frame 10 when the connector 20 is completely inserted in the frame 10 (see FIG. 6).

In the interior of each cavity 13 is provided a stopping portion 13*a* for stopping a step portion 20*b* of connector 20 and determining the insertion limit of the connector 20. In addition, an engaging portion 14 projects inward from the inner wall of each housing so as to prevent unnecessary detachment of the connector 20 from the housing.

A bolt 11 is inserted through tile central boss 12 of the frame 10. The bolt 11 has a head portion at a suitable distance from the rear end surface of frame 10 and is rotatably mounted therein by a pair of location determining stoppers 15*a* and 15*b*, the stopper 15*b* being attached after the complete insertion of bolt 11. Moreover, the front end of bolt 11 extends in a hole 16 formed in the distal portion of the boss 12.

On the other hand, each connector 20 to be coupled in the frame 10 has a square pillar type housing 21 in which a plurality of terminals (not shown) are provided. Moreover, a flexible locking arm 22 is formed integrally with the housing 21 on its central side surface.

In more detail, the locking arm 22 can present locking motion about its distal end (see FIG. 5), thereby to elastically more move inward (in the direction designated by the arrow 50 of FIG. 5). In addition, an engaging portion 23 projecting to be engaged with the corresponding engaging portion 14 on the side of frame 10 is provided on a substantially central portion of the outer side surface of arm 22. Furthermore, an operating portion 24 projecting outward to be used for disengagement is provided at the rear end of the outer side surface.

The operating portion 24 is the site to be pushed inward when the locking arm 22 is elastically transformed. Thus, the size and height are so set as to make external operation possible, that is, to expose the site from the rear end surface of frame 10 when the connector 20 will be completely inserted in the frame 10. Alternatively, the operation portion 24 may be so constructed that when the connector 20 is inserted and fixed at a suitable position in the frame 10, the engaging portion 14 on the side of frame 10 is interposed between the corresponding engaging portion 23 and that operation portion 24 to determine the position of connector 20.

On the other hand, as shown in FIG. 6, the mating connector 40 to be coupled with the above connector assembly is provided with a fixing hole 41 at its central portion in which the boss 12 of frame 10 is fixed. In addition, a projection 42 extends in the fixing hole 41 to be fixed in the above-described hole 16 of frame 10. In the periphery of the mating connector 40 are further provided holes 43 corresponding to each connector 20 so that the distal end of connector 20 is fixedly inserted therein. A plurality of terminals project upward from the bottom wall of holes 43. Moreover, a nut 45 is disposed in the axially central portion of projection 42 to be engaged with the bolt 11 of frame 10.

Next, the operation will be described.

On coupling the connectors 20 to the mating connector 40, a sub-assembly comprising the frame 10 and a necessary number of connectors 20 respectively fixed therein is prepared in advance.

Namely, the connectors 20 are inserted in each cavity 13 of frame 10 from the rear side thereof as shown in FIG. 5, the distal end of each connector 20 being directed toward the mating connector 40 to be engaged therein. In that case, the operation portion 24 of locking arm 22 is pressed to bend the arm 22 inward during the insertion, and then freed at the completion of insertion, that is, when the step portion 20*b* reaches the stopping portion 13*a*. As the result, the engaging portion 23 is fixedly engaged with the corresponding engaging portion 14 as shown in FIG. 6.

Of course, it is also possible to accomplish such engagement only by the natural bending of the locking arm 22 given from the insertion force resulting in sliding the engaging portion 14 on the front slope of locking arm 22 and then carrying it over the corresponding engaging portion 23.

Figure 7:
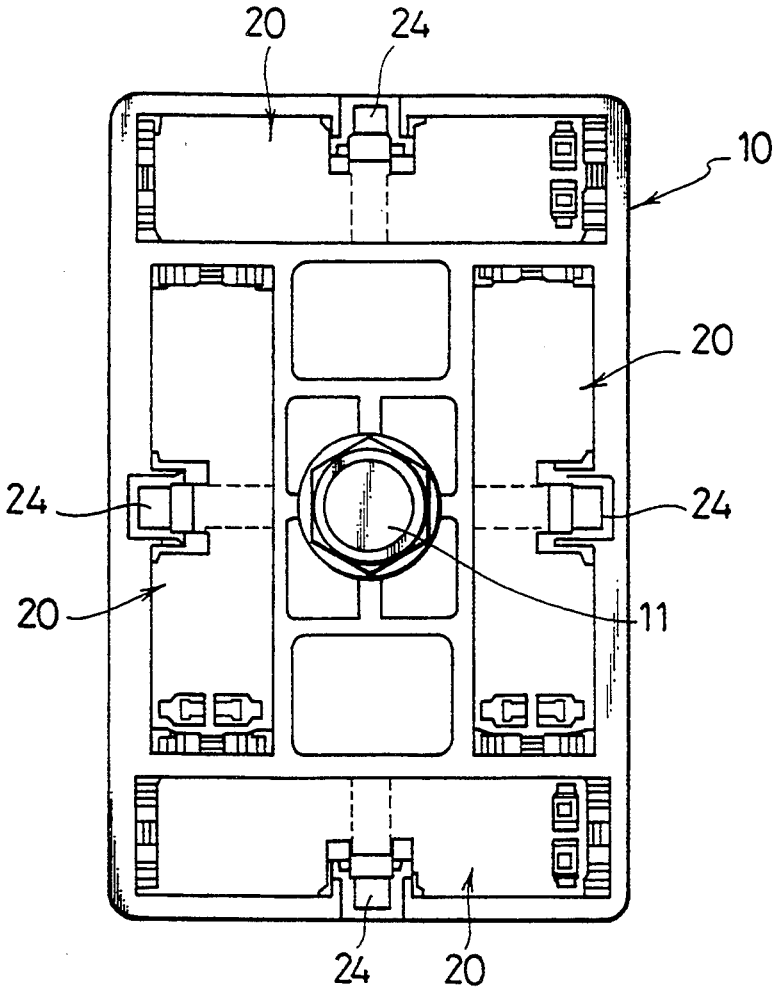
FIG. 7 is a cross section taken along the line 7—7 of FIG. 6.

FIGS. 6 and 7 show a state in which each connector 20 is mounted in the frame 10, respectively.

As shown in FIG. 6, the frame 10 and matting connector 40 are placed to face each other. Then, the frame 10 is engaged with the mating connector 40 by the parallel movement.

Figure 8:
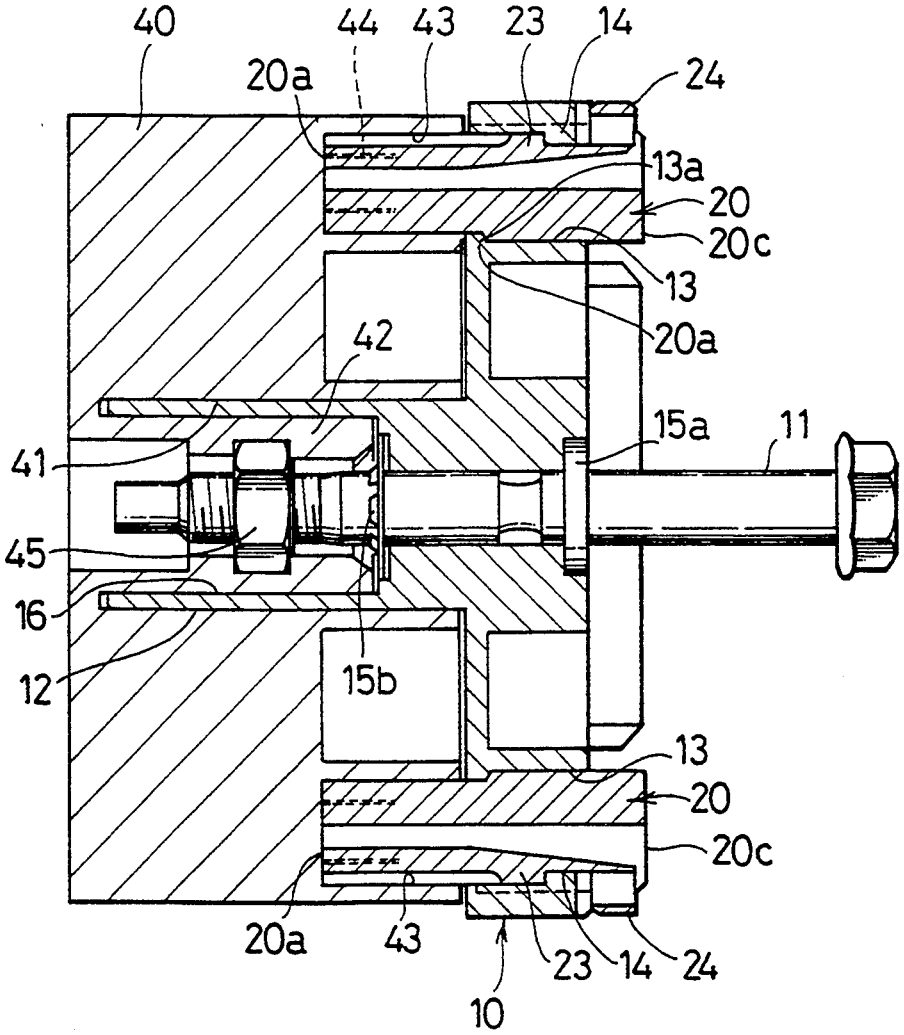
FIG. 8 is a cross section showing a state in which the connector assembly according to an embodiment of the present invention is fitted in the mating connector.

Namely, as shown in FIG. 8, the central boss 12 of frame 10 is inserted in the engaging hole 41 of mating connector 40. Thereafter, the bolt 11 is rotated to engage with the nut 45 of mating connector 40. In that manner, the frame 10 is coupled with the mating connector 40.

At the same time, each connector 20 mounted in the frame 10 is inserted in each hole 43 of the mating connector 40 to electrically connect to the terminals 44.

Figure 9:
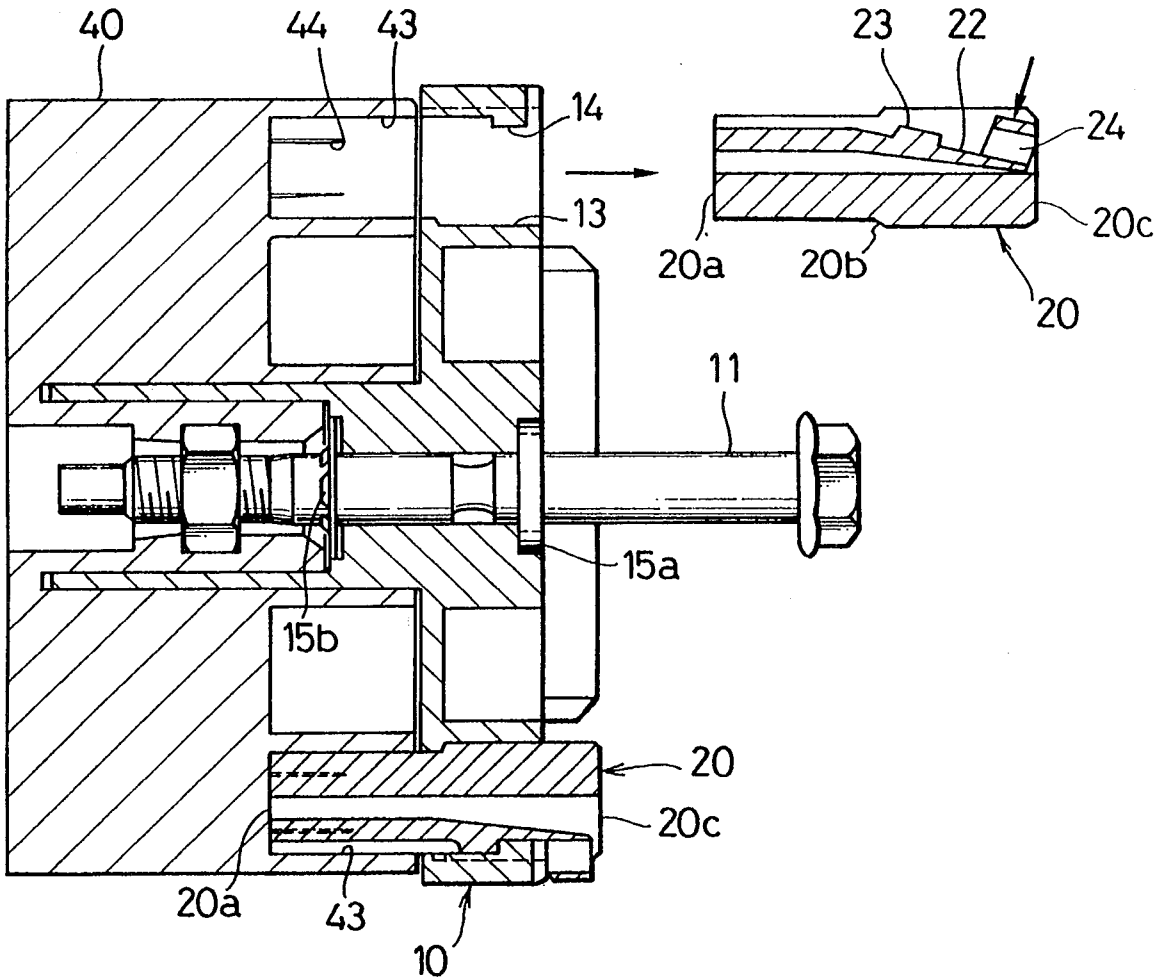
FIG. 9 is a cross section showing a state in which one connector is removed from the connector assembly according to an embodiment of the present invention.

From this state, when it is needed to remove only one connector 20, the corresponding engagement between the engaging portions 14 and 23 is removed by pushing the operation portion 24 of locking arm 22 of that connector 20 fitted in the frame 10. If the connector 20 to be removed is pulled back in such a state as shown in FIG. 9, it can be detached away from the frame 10 from the rear side thereof.

In that manner, only the specific connector 20 can be removed selectively from the frame 10 without removing the entire body of frame 10 by disengaging the bolt 11. Accordingly, the maintenance of individual connector 20 can be carried out easily without requiring any tools for disengaging the bolt 11. Of course, since additional mounting of connectors 20 to the frame 10 is also possible, the number of poles can be changed freely.

Figure 10:
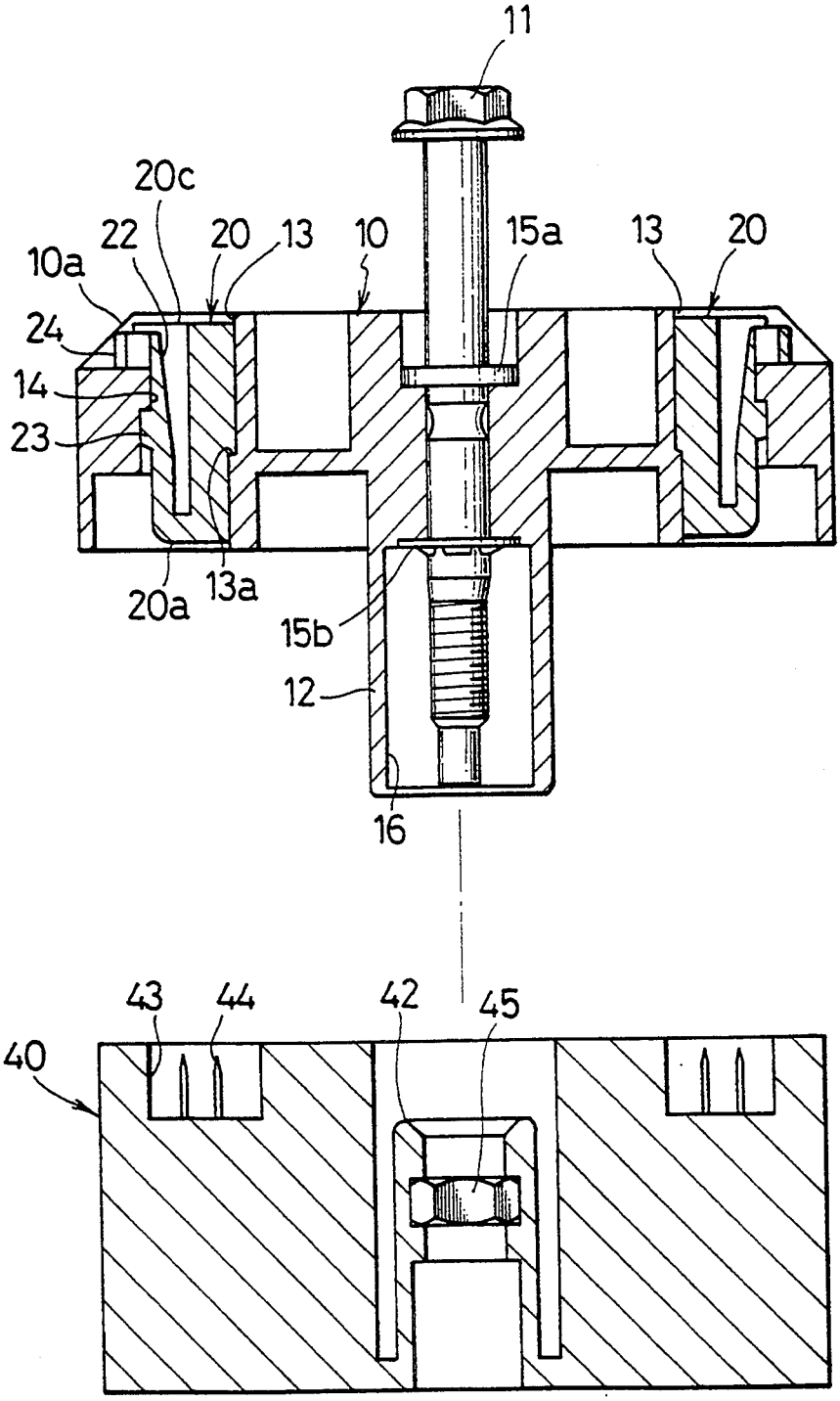
FIG. 10 is a cross section showing another embodiment of the present invention.

FIG. 10 shows a cross section of another connector assembly corresponding to another embodiment of the present invention. The same reference numerals are used in the drawing because the construction of this connector assembly is almost the same as that of the aforementioned embodiment.

As compared with the aforementioned embodiment, the connector 20 of this embodiment is formed slightly shorter, while the frame 10 is slightly thicker. Accordingly, both the end portions 20*a* and 20*c* of each connector 20 do not project out from the front and rear faces of frame 10 when the connector 20 is completely inserted therein, thereby protecting their distal ends. However, the corner portions 10*a* of frame 10 are tapered respectively so that the operation portion 24 of the locking arm can be seen from each cavity housing 13.

Accordingly, also in this embodiment, there can be obtained the same effect as in the case of aforementioned embodiment as well as sufficient protection of connectors 20 by the frame 10.

Incidentally, though each engaging portion 14 is fixedly provided on the side of frame 10 and the corresponding engaging portion 23 is provided on the locking arm 22 on the side of connector 20 in the above embodiments, it is not necessary to limit the engaging mechanism thereto. Contrary, it is also possible to provide each movable locking arm having an engaging site on the side of frame 10 and to provide a corresponding engaging portion fixedly on the side of connector 20.

Moreover, though the bolt 11 is used for coupling the frame 10 and mating connector 40 together in the above embodiments, the means other than bolts may be used.

In addition, the application area of the present invention is so wide that it can be applied also to the electric joint box or the like system.

As stated above, according to the embodiments of the present invention, the handling before or on the connector coupling work can be carried out with ease in the assembly style. The connector can be removed individually from the final connector assembly by externally operating the corresponding operation portion without removing the frame from the mating connector, thereby facilitating the maintenance of the final connector assembly. Moreover, since the additional mounting of connectors is also possible, the number of connectors can be changed optionally.

Various modifications will become possible for those skilled in the art after receiving the teachings of the present disclosure without departing from the scope thereof.

What is claimed is:

1. A connector assembly for joining branch connectors to a main connector comprising a frame capable of being affixed to the main connector and having one or more branch connectors being detachably mounted in said frame and capable of connecting with the main connector, wherein said frame includes cavities extending from a front face to a rear face of said frame and receiving each of said branch connectors from said rear face, and at least one first engaging portion for holding each respective branch connector, each of said branch connectors further including a housing having therein terminals and a flexible locking arm provided for on said housing, said flexible locking arm having a second engaging portion for engagement with said first engaging portion in said frame, and wherein one end of said flexible locking arm is fixed to said housing and a free end of said flexible locking arm second engaging portion is adapted to detachably engage said first engaging portion of said frame, said free end of said flexible locking arm being provided with an operation portion extending operably from said frame.

2. The connector assembly according to claim 1, wherein each frame cavity includes at least one inner wall and said first engaging portion in said frame is provided on said inner wall of said cavity.

3. The connector assembly according to claim 1, wherein a front end portion of each respective branch connector extends from a front end of said cavity, and a rear end portion of said respective branch connector extends from a rear end of said cavity.

4. The connector assembly according to claim 1, wherein a front end portion of each respective branch connector is recessed from said front face of said cavity and a rear end portion of said respective branch connector is recessed from said rear face of said cavity.

5. The connector assembly according to claim 1, wherein said frame includes a means for fixing said frame to said main connector.

6. The connector assembly according to claim 2, wherein a front end portion of each respective branch connector extends from a front end of said cavity, and a rear end portion of the respective branch connector extends from a rear end of said cavity.

7. The connector assembly according to claim 2, wherein a front end portion of each respective branch connector is recessed from said front face of said cavity and a rear end portion of said respective connector is recessed from said rear face of said cavity.

8. The connector assembly according to claim 2, wherein said frame includes a means for fixing said frame to said main connector.

9. The connector assembly according to claim 1, wherein a first end portion of each respective branch connector is recessed from a first face of said cavity and a second end portion of said respective branch connector extends from said a second face of said cavity.

10. The connector assembly according to claim 3, wherein said frame includes a means for fixing said frame to said main connector.

11. The connector assembly according to claim 4, wherein said frame includes a means for fixing said frame to said main connector.

12. The connector assembly according to claim 1, wherein all branch connectors can be connected the main connector through the frame at the same time.

13. An electrical connector system, comprising:

a) a first connector;

b) a frame having front and rear faces with cavities extending therebetween, wherein each of the cavities further includes a first engaging portion, said frame being capable of being affixed to the first connector at the front face of the frame: and c) at least one branch connector having a housing containing electrical terminals therein and capable of being received in a respective cavity of the frame through the frame rear face, further including a locking arm comprising:

i) a second engaging portion adapted for engaging a respective one of the first engaging portions and located near a fixed end of locking arm fixed to the housing, and ii) a free end having an operating portion for releasing said second engaging portion from said first engaging portion, wherein the operating portion extends operably from the frame.

14. The connector assembly according to claim 13, wherein all branch connectors can be connected the main connector through the frame at the same time.

* * * * *

UNITED STATES PATENT AND TRADEMARK OFFICE

CERTIFICATE OF CORRECTION

PATENT NO. : 5,378,173

DATED : January 3, 1995

INVENTOR(S) : Shigemi HASHIZAWA

It is certified that error appears in the above-indentified patent and that said Letters Patent is hereby corrected as shown below:

IN THE TITLE PAGE:

Correct the name of the assignee as follows:

Item: [73] Assignee: Yazaki Corporation, Tokyo, Japan

Signed and Sealed this

Second Day of December, 1997

*Attest:*

Bruce Lehman

BRUCE LEHMAN

*Attesting Officer*

*Commissioner of Patents and Trademarks*